US011162675B2

(12) United States Patent
Heino et al.

(10) Patent No.: US 11,162,675 B2
(45) Date of Patent: Nov. 2, 2021

(54) SUPPORTING BEAM ARRANGEMENT FOR SUPPORTING A FLUE GAS DUCT

(71) Applicant: Valmet Technologies Oy, Espoo (FI)

(72) Inventors: Tero Heino, Tampere (FI); Juha Ojanperä, Pirkkala (FI)

(73) Assignee: Valmet Technologies Oy, Espoo (FI)

( * ) Notice: Subject to any disclaimer, the term of this patent is extended or adjusted under 35 U.S.C. 154(b) by 0 days.

(21) Appl. No.: 16/859,240

(22) Filed: Apr. 27, 2020

(65) Prior Publication Data

US 2020/0386399 A1 Dec. 10, 2020

(30) Foreign Application Priority Data

Jun. 10, 2019 (FI) ..... 20195490

(51) Int. Cl.
*F22B 37/24* (2006.01)
*F22B 31/00* (2006.01)

(52) U.S. Cl.
CPC ..... *F22B 37/24* (2013.01); *F22B 31/0084* (2013.01); *F23C 2202/00* (2013.01)

(58) Field of Classification Search
CPC ..... F22B 37/24; F22B 37/242; F22B 37/207; F28F 9/007
See application file for complete search history.

(56) References Cited

U.S. PATENT DOCUMENTS 1,877,391 A 4/1932 Bence
2,987,052 A 6/1961 Armacost
3,608,525 A 9/1971 Sharan
3,842,904 A * 10/1974 Gardenier ..... F28F 19/00 165/145
4,286,549 A * 9/1981 Eisinger ..... F22B 37/244 122/510

(Continued)

FOREIGN PATENT DOCUMENTS

EP 2927581 A1 10/2015
JP H08285207 A 11/1996

OTHER PUBLICATIONS

European Patent Office, Extended European Search Report for European Patent Application No. 20397504.0, dated Sep. 11, 2020, (9 pages), European Patent Office, Tampere, Finland.

*Primary Examiner* — Gregory A Wilson
(74) *Attorney, Agent, or Firm* — Alston & Bird LLP

(57) ABSTRACT

A supporting beam arrangement (14) for supporting a flue gas duct (10) to a support frame (16) of the flue gas duct. The supporting beam arrangement comprises two horizontal first supporting beams (18) that are parallel and on two opposite sides of the flue gas duct (10) and separated by a distance from the flue gas duct, and further are connected to the support frame (16). The supporting beam arrangement (14) comprises a horizontal second supporting beam (20) defining two opposite ends (22) that are supported to the first supporting beams (18), the second supporting beam extending through the flue gas duct (10) that is supported to the second supporting beam. At least one or each one of the first supporting beams comprises an opening (24), in which opening one of the two opposite ends (22) of the second supporting beam is placed to rest on the first supporting beam (18). A power boiler (50) comprises the supporting beam arrangement (14), the flue gas duct (10) and the support frame (16).

21 Claims, 4 Drawing Sheets

(56) References Cited

U.S. PATENT DOCUMENTS

| | | | | |
|---|---|---|---|---|
| 4,685,426 | A | 8/1987 | Kidaloski et al. | |
| 5,329,892 | A * | 7/1994 | Svendsen | F22B 31/003 122/4 D |
| 5,339,891 | A | 8/1994 | Kidaloski et al. | |
| 6,039,008 | A * | 3/2000 | Anderson | F22B 31/0084 122/4 D |
| 8,596,227 | B2 * | 12/2013 | Heinrichs | F22B 15/00 122/510 |
| 9,291,342 | B2 * | 3/2016 | Kramer | F01D 25/30 |
| 9,964,301 | B2 * | 5/2018 | Lankinen | F22B 31/0084 |
| 2008/0276885 | A1 * | 11/2008 | Seppanen | F22B 37/24 122/510 |
| 2012/0279596 | A1 | 11/2012 | Kramer et al. | |

* cited by examiner

SUPPORTING BEAM ARRANGEMENT FOR SUPPORTING A FLUE GAS DUCT

CROSS REFERENCE TO RELATED APPLICATIONS

This application claims priority to and the benefit of Finnish Patent Application No. FI20195490, filed on Jun. 10, 2019, the contents of which as are hereby incorporated by reference in their entirety.

BACKGROUND

Related Field

The solution to be presented relates to a supporting beam arrangement for supporting a flue gas duct. The supporting beam arrangement is adapted to support the flue gas duct to a support frame of the flue gas duct of a power boiler in particular. The support frame may further be adapted to support the power boiler and include supporting beams and pillars to support the flue gas duct to the ground.

Description of Related Art

Power boiler systems, especially steam boilers of CFB (circulating fluidized bed) and BFB (bubbling fluidized bed) design, have a furnace with heat transfer surfaces and for burning e.g. conventional fuel, biomass or municipal solid waste. Hot flue gases produced in the furnace are conveyed to a flue gas duct constituting a vertical convection pass through which the flue gases flow, e.g. downwards. Heat exchangers including banks of tubes and located within the convection pass provide heat transfer surfaces which transfer heat from the flue gases to the medium flowing inside the tubes, the medium being steam, water or air.

The heat exchangers of the convection pass may include preheaters, e.g. an economizer adapted to cool down the flue gases and preheat water fed to a water circulation system of the power boiler, and an air heater downstream of the economizer, for preheating combustion air to be conveyed into the furnace.

Document EP 2927581 A1 discloses a power steam boiler comprising a flue gas duct with heat exchangers and a boiler house, i.e. a support frame, with beams and columns for supporting the flue gas duct.

Furthermore, documents JP H08285207 A, US 6039008 A and US 4685426 A disclose a supporting beam arrangement for supporting a flue gas duct.

Supporting beam arrangements for supporting the flue gas duct may include beams that extend through the flue gas duct in such a way that the beams are exposed to hot flue gases. Furthermore, the supporting beam arrangements may include beams, e.g. primary, secondary and tertiary beams that are connected to or supported on top of each other. Therefore, the design of supporting beams for use in such circumstances must be optimized when e.g. the strength of the beam is critical, or the total height and structure of the support frame or flue gas duct need to be taken into consideration.

BRIEF SUMMARY

In the supporting beam arrangement according to the present solution the flue gas duct is adapted to convey flue gases and the supporting beam arrangement is adapted to support the flue gas duct to a support frame of the flue gas duct.

The supporting beam arrangement comprises two substantially horizontal first supporting beams that are substantially parallel and situated on two opposite sides of the flue gas duct, the first supporting beams being separated by a distance from the flue gas duct, and the first supporting beams including two opposite ends that are connected to the support frame.

The supporting beam arrangement further comprises a substantially horizontal second supporting beam defining two opposite ends that are supported to the first supporting beams. The second supporting beam extends through the flue gas duct in such a way that the second supporting beam is exposed to flue gases and flue gas duct is supported to the second supporting beam.

In the present solution at least one or each one of the first supporting beams comprises an opening, in which opening one of the two opposite ends of the second supporting beam is placed to rest on the first supporting beam in such a way that loads incurred by the weight of the flue gas duct are transmitted to the first supporting beam.

It is well known that supporting beams are placed on top of each other in such a way that an upper supporting beam is supported on a lower supporting beam. The supporting beam arrangement of the presented solution provides the benefit of reducing the total height of the supporting beam arrangement that includes the first and second supporting beams. Therefore, successive heat exchangers in the flue gas duct may be placed closer to each other in a vertical direction when the structure of the flue gas duct and/or the support frame does not allow heat exchangers to be placed at the height level of the supporting beams.

Additionally, the total height of the support frame and/or the flue gas duct may be reduced which is beneficial when designing the layout of the power boiler to which the support frame and the flue gas duct belong.

According to an example of the presented solution, the support frame comprises vertical pillars and each end of the first supporting beam is connected to one of the pillars by means of which pillars the first supporting beam is supported to the ground.

The supporting beam arrangement in this example of the presented solution provides the benefit of reducing further the total height of the supporting beam, the support frame, and/or the flue gas duct.

In this example, there is no need for horizontal primary supporting beams that are connected to the pillars and to which primary supporting beams the ends of the first supporting beams are connected, the primary supporting beams being substantially perpendicular to the first supporting beams. Thereby, the second supporting beams are configured to extend from the flue gas duct to between the pillars where the first supporting beams connected to the pillars are located.

According to an example of the presented solution, the second supporting beam includes a middle section extending within the flue gas duct and defining a first beam height and two end sections extending outside the flue gas duct, at least one or each one of the end sections defining a second beam height. The second beam height is smaller than the first beam height.

The supporting beam arrangement in this example of the presented solution provides the benefit of providing a supporting beam with a design taking the hot conditions prevailing inside the flue gas duct into consideration by having an increased beam height where the supporting beam is prone to increased bending owing to the hot conditions.

A further benefit provided by the second supporting beam including the middle and end sections with the differing beam heights is the option of placing further supporting beams, e.g. intermediate supporting beams, or reinforcing bars, above the end sections that extend to a height lower than the middle section. This example reduces further the total height of the supporting beam arrangement. A particularly compact structure is provided when the intermediate supporting beams and/or reinforcing bars extend to a height lower than the middle section and/or the first supporting beams.

According to an example of the presented solution, the supporting beam arrangement comprising slide bearings in the openings. At least one or each one of the ends of the second supporting beam rests on one of the slide bearings. The slide bearing is supported to the first supporting beam.

The second supporting beams are exposed to hot flue gases in the flue gas duct and thus, they are designed for hot conditions and therefore the second supporting beams are subject to thermal expansion. Thermal expansion is the tendency of the supporting beam to change in length in response to a change in temperature. The first supporting beam and the support frame are designed for cold conditions and therefore, in order to allow the thermal expansion of the second supporting beams to take place, there are slide bearings between the first and second supporting beams.

According to an example, the supporting beams and pillars may be I-beams, H-beams or box beams. Preferably, the supporting beams and pillars are made of steel. The supporting beams and pillars may be fabricated e.g. by rolling, welding, riveting, and/or extrusion. The supporting beams may be connected to the pillars and each other by means of welded or bolted connections.

The presented solution will be more fully appreciated by reference to the following detailed description of the illustrative embodiments in accordance with the solution, when taken in conjunction with the accompanying illustrative drawings.

DETAILED DESCRIPTION OF VARIOUS EMBODIMENTS

Figure 1:
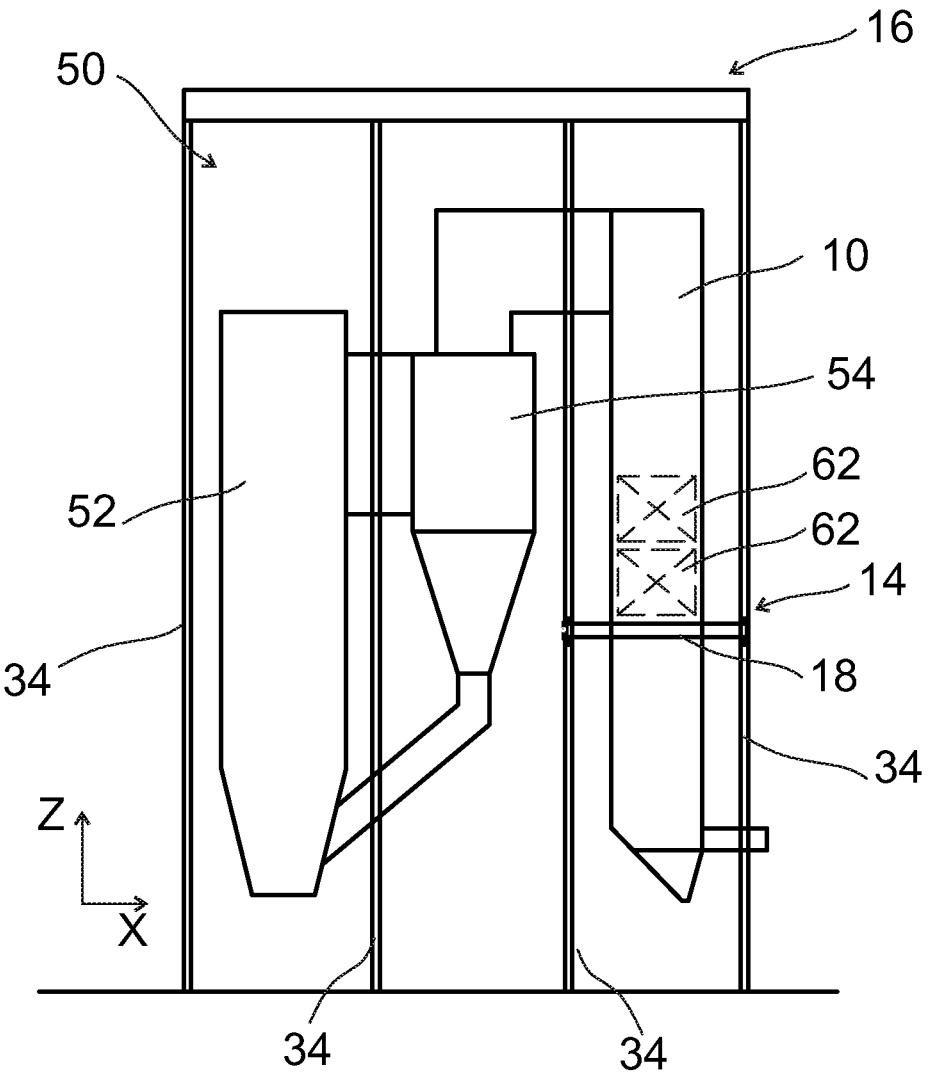
FIG. 1 schematically illustrates an example of a power boiler in the flue gas duct of which the present solution can be applied.

Reference will now be made to the examples of which are illustrated in the accompanying drawings. Wherever possible, the same or corresponding reference numbers will be used throughout the drawings to refer to the same or corresponding parts or features.

The figures are intended for illustrating examples of the presented solution. Therefore, the figures are not in scale or suggestive of a definite layout of system components.

In the text, reference is made to the figures with the following reference numbers and denotations:

10 Flue gas duct
14 Supporting beam arrangement
16 Support frame
18 First supporting beam
20 Second supporting beam
22 End of second supporting beam
24 Opening
26 Upper flange
28 Lower flange
30 Web
32 Top surface of first supporting beam
34 Pillar
36 Middle section of second supporting beam
38 End section of second supporting beam
40 Outer end section of second supporting beam
42 Top surface of middle section
44 Top surface of end section
46 Intermediate supporting beam
48 Reinforcing bars
50 Power boiler
52 Furnace
54 Cyclone separator
56 Upper wall or lower wall
58 Side wall
60 Slide bearing
62 Heat exchanger In the figures, the vertical direction is denoted by an arrow Z and the two orthogonal, horizontal directions are denoted by arrows X and Y. The horizontal directions are orthogonal in relation to the vertical direction.

According to an example shown in FIG. 1, a power boiler 50 in relation to which the presented solution is also illustrated and applied comprises, at least, a furnace 52 and a flue gas duct 10 for conveying flue gases, the flue gas duct 10 including a vertical section in which flues gases flow downwards. There are heat exchangers in the flue gas duct 10, which may include preheaters, e.g. an economizer adapted to cool down the flue gases and preheat water fed to a water circulation system of the power boiler 50, and an air heater downstream of the economizer. The power boiler 50 further includes a support frame 16 for supporting the furnace 52 to the ground and a supporting beam arrangement 14 for supporting the flue gas duct to the support frame 16.

Preferably, the power boiler 50 is a steam boiler of CFB (circulating fluidized bed) or BFB (bubbling fluidized bed) design. The power boiler 50 may comprise further devices that are relevant for the design in question but are not shown in the figures. The power boiler 50 may additionally comprise a cyclone separator 54 connected to the furnace 52 for separating solid particles from flue gases coming from the furnace 52. The cyclone separator 54 may be supported to the support frame 16.

The presented solution relates to a supporting beam arrangement 14 for supporting a flue gas duct 10 which is adapted to convey flue gases past heat exchangers. The supporting beam arrangement 14 is adapted to support the flue gas duct 10 to a support frame 16 of the flue gas duct 10.

Figure 2:
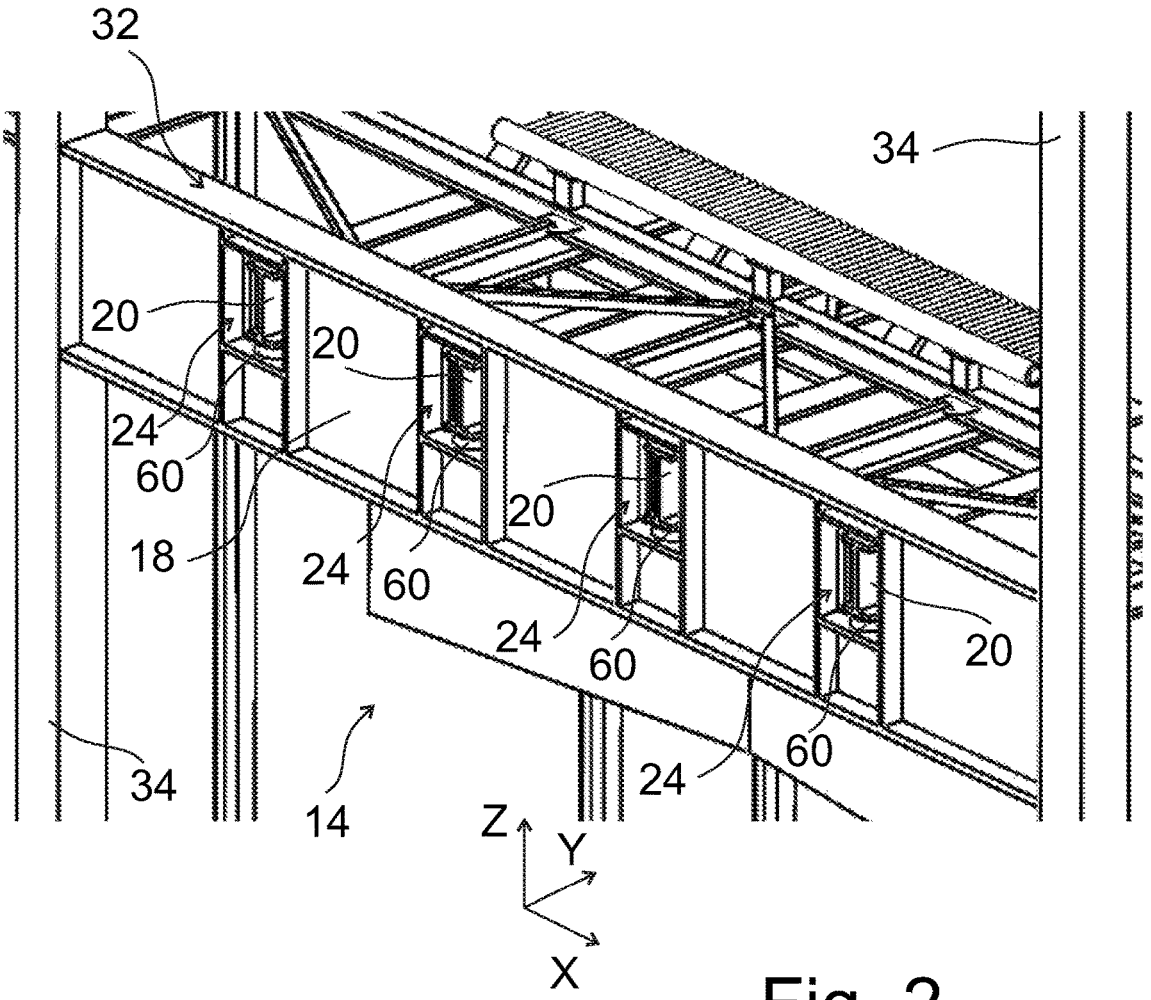
FIG. 2 schematically illustrates an example of the supporting beam arrangement according to the present solution.
Figure 4:
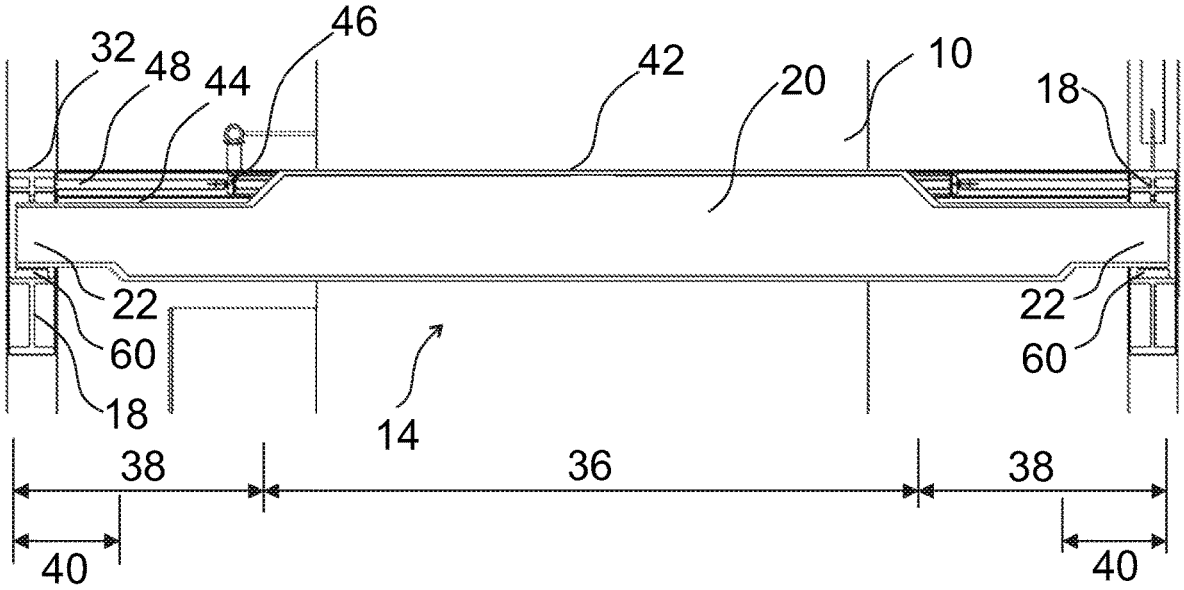
FIG. 4 schematically illustrates an example of a supporting beam of the supporting beam arrangement of FIG. 2.
Figure 6:
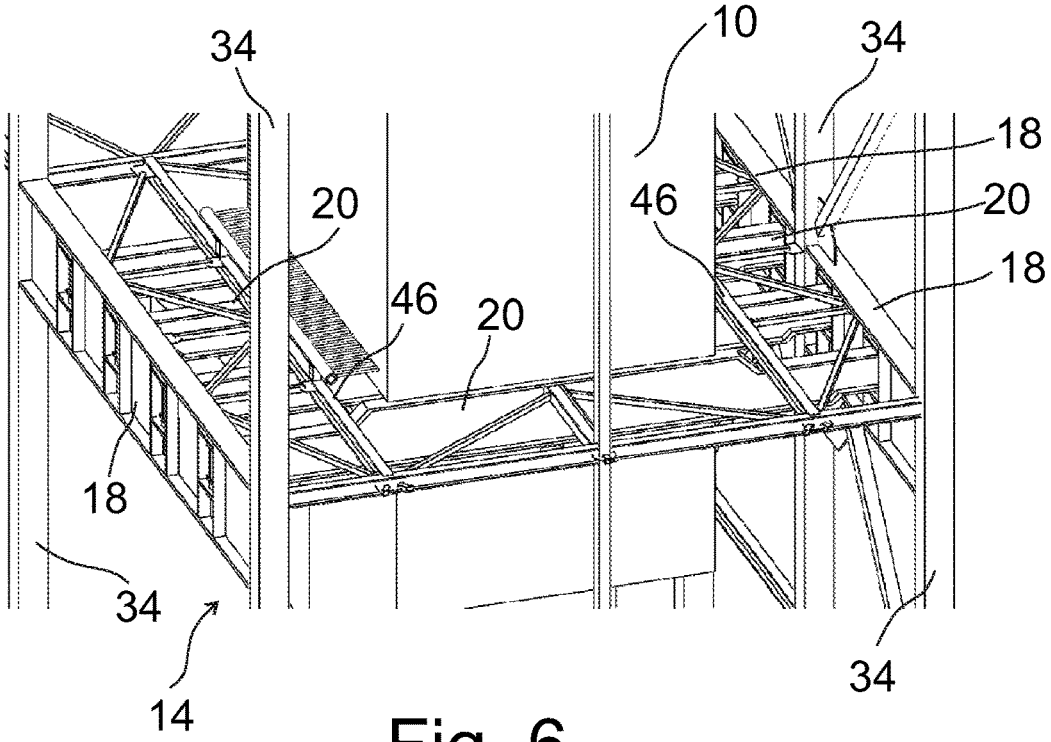
FIG. 6 schematically illustrates the supporting beam arrangement of FIG. 2.

According to an example shown in FIGS. 2, 4 and 6, the supporting beam arrangement 14 comprises two substantially horizontal first supporting beams 18, a substantially horizontal second supporting beam 20 defining two opposite ends 22, and an opening 24 in each first supporting beam 18, the opening 24 being for one of the ends 22 of the second supporting beam 20.

The supporting beam arrangement 14 may, as shown in the example in FIG. 2, comprise additional second supporting beams 20 and openings 24 in each first supporting beam 18 in such a way that the principles explained below apply. The first supporting beam 18 may be replaced with two successive, short first supporting beams 18 as shown in FIG. 6 and being separated by a pillar 34 to which the consecutive first supporting beams 18 are connected.

The two substantially horizontal first supporting beams 18 are parallel and situated on two opposite sides of the flue gas duct 10. The first supporting beams 18 are separated by a distance from the flue gas duct 10 and the first supporting beams 18 include two opposite ends that are connected to the support frame 16.

The two opposite ends 22 of the second supporting beam 20 are supported to the first supporting beams 18 and the second supporting beam 20 extends through the flue gas duct 10 in such a way that the second supporting beam 20 is exposed to flue gases. The flue gas duct 10 is supported to the second supporting beam 20.

Each first supporting beam 18 comprises an opening 24, in which opening 24 one of the two opposite ends 22 of the second supporting beam 20 is placed to rest on the first supporting beam 18 in such a way that loads incurred by the weight of the flue gas duct 10 are transmitted to the first supporting beam 18.

Figure 3:
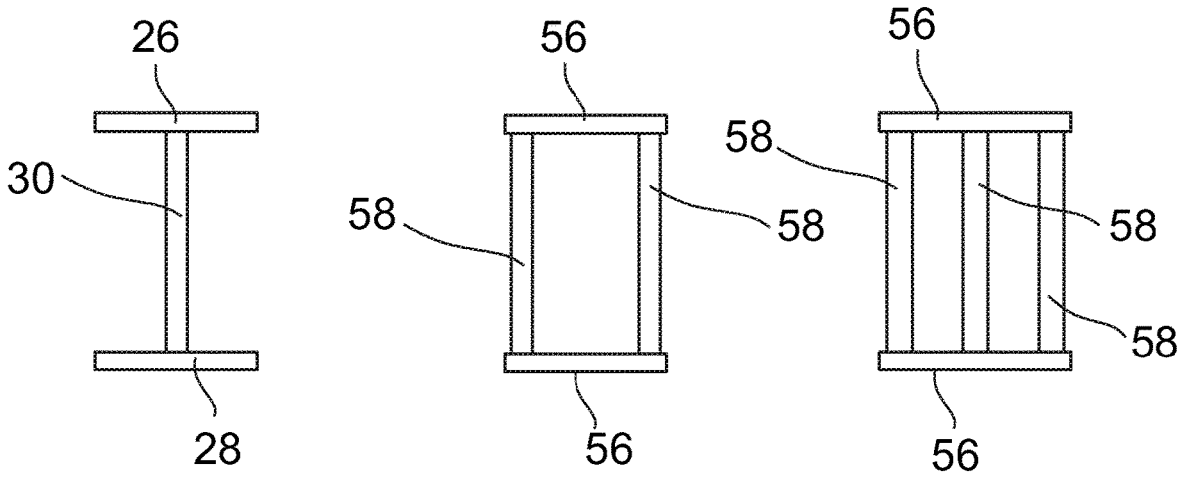
FIG. 3 schematically illustrates examples of the beams applied in the supporting beam arrangement.

According to an example in FIG. 2, the first supporting beam 18 is an I-beam or a H-beam, including upper and lower flanges 26, 28 that are parallel, extend in a longitudinal direction of the beam, and are connected by a web 30 extending in the longitudinal direction, as shown in FIG. 3 on the left.

In the I-beam or H-beam, the opening 24 may be formed to the web 30 of the beam, underneath the upper flange 26 and above the lower flange 28.

According to another example, the first supporting beam 18 is a box beam with one or more walls attached to each other and extending in the longitudinal direction.

According to an example, as shown in FIG. 3 in the middle and on the right, the box beam includes upper and lower walls 56 that are parallel, extend in a longitudinal direction of the beam and are connected by two or more side walls 58 extending in the longitudinal direction.

The box beam may be fabricated by attaching two or more beams, e.g. I-beams, H-beams, and/or U-beams to each other in such a way that the upper and lower walls 56 are formed by the upper and lower flanges 26 and 28, respectively, and the side walls 58 are formed by the webs 30. The box beam may have a rectangular or square cross-section. Preferably, the box beam provides a hollow structure with at least one hollow cell. Preferably, the box beam provides at least one closed cell.

In the box beam, the opening 24 may be formed to all side walls 58 or at least one of the side walls 58, underneath the upper wall 56 and above the lower wall 56.

Thus, the opening 24 may go through the first supporting beam 18 in such a way that the opening 24 gives access from one side of the first supporting beam 18 to the other side of the first supporting beam 18. This is the case in particular for the I-beams and H-beams.

Alternatively, the opening 24 may go through at least one side wall 58 of the first supporting beam 18 in such a way that the opening 24 gives access from one side of the first supporting beam 18 to the inside of the first supporting beam 18. Alternatively, the opening 24 may go through all the side walls 58 of the first supporting beam 18 in such a way that the opening 24 gives access from one side of the first supporting beam 18 to the other side of the first supporting beam 18. This is the case in particular for the box beams.

The supporting beam arrangement 14 further comprises slide bearings 60 in the openings 24 as shown in FIGS. 2 and 4. Each end 22 of the second supporting beam 20 rests on one of the slide bearings 60 and the slide bearings 60 are supported to the first supporting beams 18. Thereby the second supporting beam 20 is supported to the first supporting beam 18 via the slide bearings 60. The slide bearings 60 allow the thermal expansion of the second supporting beam 20 to take place and movement of each end 22 of the second supporting beam 20 in a substantially horizontal direction, e.g. in the longitudinal direction of the second supporting beam 20, in relation to first supporting beam 18. Preferably, each slide bearing 60 is in the opening 24 in a vertical direction between the first supporting beam 18 and one of the ends 22 of the second supporting beam 20.

At or around the opening 24, see FIG. 2, the first supporting beam 18 may have stiffeners to stiffen the first supporting beam 18 against deformations. The stiffeners may be plates or flanges attached to e.g. the web 30, the upper flange 26, the lower 28, the upper wall 56, the lower wall 56, and/or the side wall 58.

According to an example, on one side of the first supporting beam 18, plates or flanges are attached to the first supporting beam 18 to cover, shield or enclose the end 22 of the second supporting beam 20, and the slide bearing 60, placed in the opening 24.

Regarding the support frame 16, according to an example as shown in FIGS. 1, 2 and 6, the support frame 16 comprises vertical pillars 34 by means of which the first supporting beams 18 are supported to the ground. Each end of the first supporting beams 18 is connected to one of the pillars 34. Thereby, loads incurred by the weight of the flue gas duct 10 are transmitted to the pillars 34 directly by the first supporting beams 18.

According to an alternative example, the support frame 16 comprises vertical pillars 34 and two substantially horizontal primary supporting beams. The primary supporting beams are substantially parallel, and each primary supporting beam includes two opposite ends that are connected to the pillars 34 by means of which the primary supporting beams are supported to the ground. In this example, each end of the first supporting beams 18 is connected to one of the primary supporting beams. Thereby, loads incurred by the weight of the flue gas duct 10 are transmitted to the pillars 34 not directly by the first supporting beams 18 but via the primary supporting beams.

Preferably, the primary supporting beams are substantially perpendicular to the first supporting beams 18.

According to an example, the first supporting beam 18 defines a substantially horizontal top surface 32, see FIGS. 2 and 4. Preferably, the opening 24 and the end 22 of the second supporting beam 20 in the opening 24 are located underneath the top surface 32 which extends in a continuous manner in the longitudinal direction.

The top surface 32 may be formed by the upper flange 26, or the upper wall 56, discussed above.

Regarding the second supporting beam 20, according to an example as shown in FIG. 4 the second supporting beam 20 includes a middle section 36 horizontally extending within the flue gas duct 10 and two end sections 38, each end section 38 horizontally extending outside the flue gas duct 10 between the flue gas duct 10 and one of the first supporting beams 18.

The middle section 36 and either one or preferably both of the end sections 38 may define a stepped shape for the second supporting beam 20, See FIG. 4.

Additionally, the middle section 36 may define a substantially horizontal top surface 42 and each end section 38 may define a substantially horizontal top surface 44. In an example the second supporting beam 20 has the stepped shape in such a way that the top surfaces 44 of the end sections 38 are at a height lower than the top surface 42 of the middle section 36. Preferably, the top surfaces 44 of the end sections 38 of the second supporting beam 20 are at the same height.

The stepped shape enables placing additional supporting or reinforcing beams or bars above the end sections 38 of the second supporting beam 20 in a compact manner for providing structures with a reduced height.

Alternatively, or additionally in relation to the stepped shape discussed above, see FIG. 5, the middle section 36 defines a first beam height B1 and each end section 38 defines a second beam height B2. The second beam height B2 is smaller than the first beam height B1 and the second beam height B2 is at the most 90%, 80%, or 70%, or at the most 60% of the first beam height B1.

Additionally, the second supporting beam 20 may further include two outer end sections 40, each outer end section 40 including one of the ends 22 of the second supporting beam 20 and horizontally extending outside the flue gas duct 10 between the flue gas duct 10 and one of the first supporting beams 18.

Additionally, in relation to the stepped shape discussed above, each outer end section 40 defines a third beam height B3. The third beam height B3 is smaller than the second beam height B2 and the third beam height B3 is at the most 90%, 80%, or 70%, or at the most 60% of the second beam height B2.

According to an example, the top surface 32 of the first supporting beam 18 is at a first height H1 and the top surface 44 of each end section 38 of the second supporting beam 20 is at a second height H2, the second height H2 being less than the first height H1.

The difference in height enables placing additional supporting or reinforcing beams or bars above the end sections 38 of the second supporting beam 20 in a compact manner for proving structures with a reduced height.

According to an example, additionally the top surface 42 of the middle section 36 in the second supporting beam 20 is at a third height H3, the second height H2 being less than the third height H3.

Figure 7:
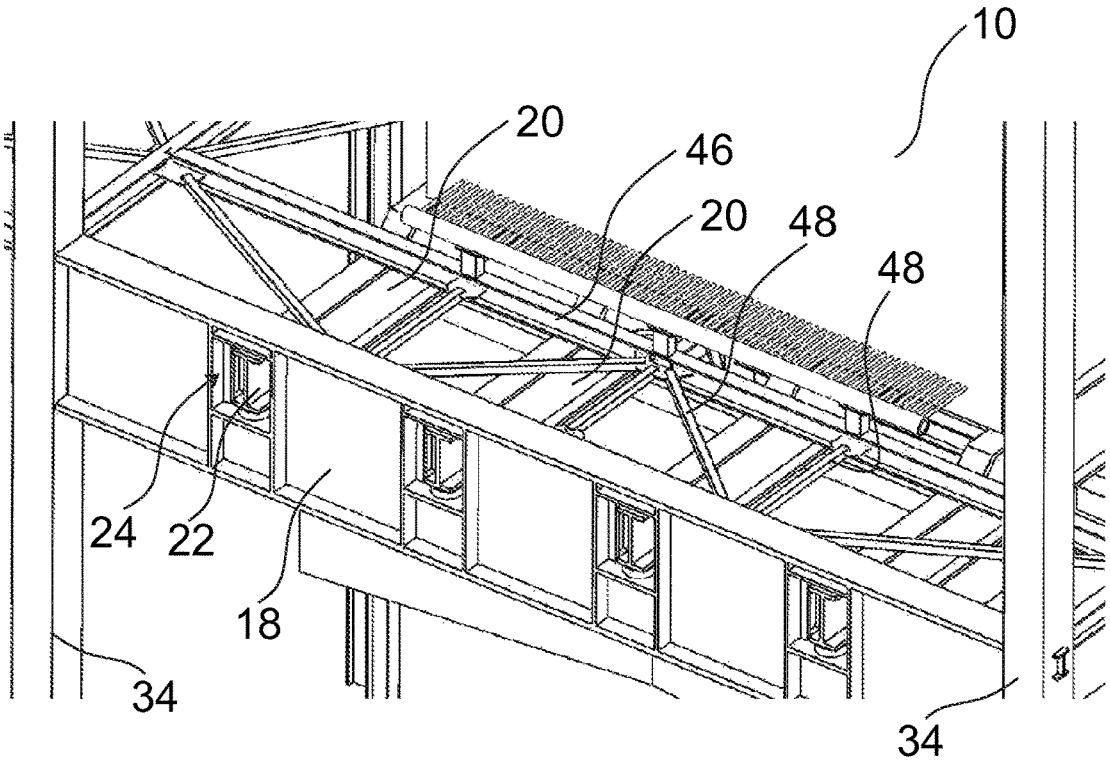
FIG. 7 schematically illustrates details of the supporting beam arrangement of FIG. 6.

According to an example as shown in FIG. 7, the supporting beam arrangement 14 further comprises a substantially horizontal intermediate supporting beam 46 that is substantially parallel with the first supporting beams 18 and substantially perpendicular to the second supporting beam 20. The intermediate supporting beam 46 is supported to the support frame 16, e.g. to the pillars 34, either directly or via another supporting beam.

In an example as shown in FIG. 4, for providing a compact structure, the intermediate supporting beam 46 is in a vertical direction located above the top surface 44 of one of the end sections 38 in the second supporting beam 20.

According to an example as shown in FIG. 7, the supporting beam arrangement 14 further comprises substantially horizontal reinforcing bars 48 each having a first end connected to one of the first supporting beams 18 and an opposing second end connected to the intermediate supporting beam 46.

The reinforcing bars 48 may be substantially perpendicular to the first supporting beams 18 and/or the reinforcing bars 48 extend at an oblique angle in relation to the first supporting beams 18.

According to an example, to provide a compact structure, at least some of the reinforcing bars 48 are in a vertical direction located above the top surface 44 of the end sections 38 of the second supporting beam 20.

Figure 5:
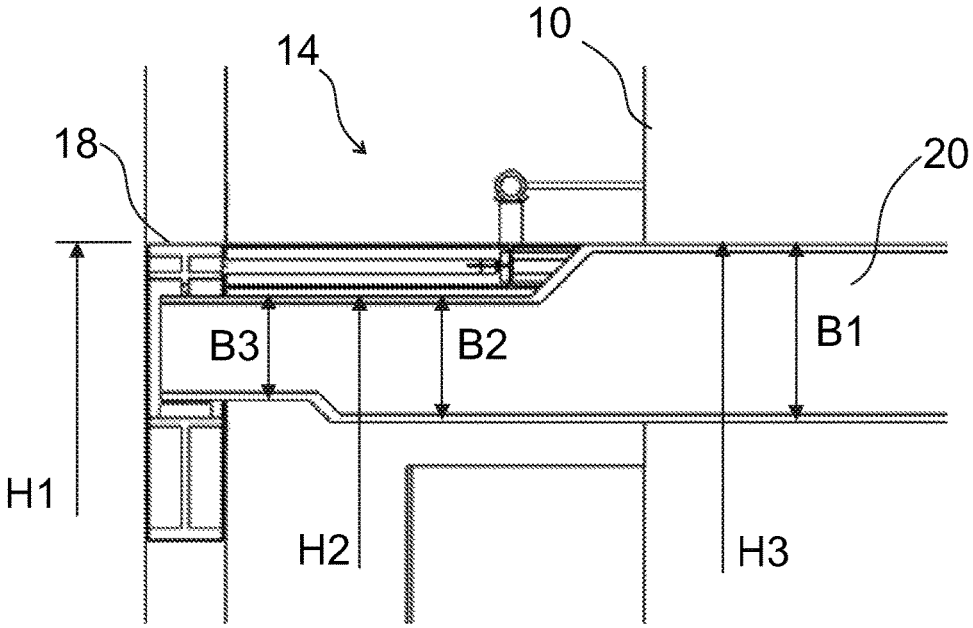
FIG. 5 schematically illustrates details of the supporting beam shown in FIG. 4.

According to an example, to provide a compact structure with a reduced height, the reinforcing bars 48 are additionally placed at a height lower than the top surfaces 32 of first supporting beams 18, see FIGS. 4 and 5.

The power boiler 50 in relation to which the presented solution may be applied comprises, as described above, the supporting beam arrangement 14, the flue gas duct 10 and the support frame 16, see FIG. 1.

Preferably, the flue gas duct 10 comprises at least one heat exchanger 62 constituting e.g. an economizer and including a bank of tubes and adapted to transfer heat from the flue gases to medium flowing inside tubes of the bank of tubes. Preferably, the flue gas duct 10 conveys flue gases downwards in a vertical direction. The heat exchanger 62 is supported to the flue gas duct 10 and, according to an example, additionally to the second supporting beam 20. The supporting beam arrangement 14 may be located below the heat exchanger 62, e.g. an economizer.

The principles in the examples presented above in relation to the second supporting beam 20 apply to any additional supporting beam that is parallel with the above-mentioned second supporting beam 20 and constitutes an additional second supporting beam 20. The first supporting beams 18 comprises openings 24 for each second supporting beam 20 in a manner described above. According to an example, there are four second supporting beams 20.

Also, according to an example, only one of the first supporting beams 18 may apply the principles in the examples presented above. Also, according to an example, only one end 22 of the second supporting beam 20 may apply the principles in the examples presented above. Therefore, the principles in the examples presented above may be applied on one side or, preferably, on both sides of the flue gas duct 10 to provide a compact structure.

Structures and elements described in connection with an example above may be used also in the other examples presented above where appropriate. The solution presented above in relation to the supporting beam arrangement 14 may be applied in relation to both ends 22 of the second supporting beam 20.

It is to be understood that the examples of the solution disclosed are not limited to the structures disclosed herein, but are extended to equivalents thereof as would be recognized by those skilled in the relevant art.

It should also be understood that terminology employed herein is used for the purpose of describing examples only and is not intended to be limiting. Reference throughout this specification to "one example" or "an example" means that a feature, structure, or characteristic described in connection with the example is included in at least one example of the present solution.

As used herein, a plurality of items or structural elements may be presented in a common list for convenience. However, these lists should be construed as though each member of the list is individually identified as a separate and unique member.

In this description, the terms "substantially vertical" and "substantially horizontal" may be replaced with the terms "vertical" and "horizontal". The direction of the acceleration due to gravity is defined as the "vertical direction", the "horizontal direction" defining directions perpendicular to the vertical direction. In relation to the orientations defined in this description, see e.g. "substantially vertical", "substantially horizontal", "substantially perpendicular", and "substantially parallel", they also include orientations at angles in relation to absolute vertical, horizontal, perpendicular, and parallel directions, whereby the angles cover a range of angles considered reasonable when taking production tolerances and installation work into consideration, and without departing from the concept of the presented solution. According to an example, the range of angles covers angles between −10° and +10°, or between −5° and +5°.

The verbs "to comprise" and "to include" are used in this document as open limitations that neither exclude nor require the existence of also un-recited features. Furthermore, it is to be understood that the use of "a" or "an", i.e. a singular form, throughout this document does not exclude a plurality, unless where specifically mentioned.

While the solution has been described by way of examples it is to be understood that the solution is not limited to the disclosed examples but is intended to cover various combinations or modifications within the scope of the appended claims.

The invention claimed is:

1. A supporting beam arrangement for supporting a flue gas duct configured to convey flue gases, the supporting beam arrangement being configured to support the flue gas duct to a support frame of the flue gas duct, the supporting beam arrangement comprising:

two substantially horizontal first supporting beams that are substantially parallel and situated on two opposite sides of the flue gas duct, the first supporting beams being separated by a distance from the flue gas duct, and the first supporting beams including two opposite ends that are connected to the support frame; and a substantially horizontal second supporting beam defining two opposite ends that are supported by the first supporting beams, the second supporting beam extending through the flue gas duct in such a way that the second supporting beam is exposed to flue gases, wherein the flue gas duct is supported by the second supporting beam, wherein:

at least one or each one of the first supporting beams comprises an opening, in which opening one of the two opposite ends of the second supporting beam is placed to rest on the first supporting beam in such a way that loads incurred by the weight of the flue gas duct are transmitted to the first supporting beam;

the second supporting beam comprises:

a middle section horizontally extending within the flue gas duct, the middle section defining a substantially horizontal top surface, and two end sections, each end section horizontally extending outside the flue gas duct between the flue gas duct and one of the first supporting beams, each end section defining a substantially horizontal top surface; and the middle section and the end sections define a stepped shape in such a way that at least one or each one of the top surfaces of the end sections is at a height lower than the top surface of the middle section.

2. The supporting beam arrangement of claim 1, wherein the first supporting beam is one of:

an I-beam, including upper and lower flanges that are parallel, extend in a longitudinal direction of the beam, and are connected by a web extending in the longitudinal direction, wherein the opening is formed to the web of the beam, underneath the upper flange and above the lower flange, a H-beam, including upper and lower flanges that are parallel, extend in a longitudinal direction of the beam, and are connected by a web extending in the longitudinal direction, wherein the opening is formed to the web of the beam, underneath the upper flange and above the lower flange, or a box beam including upper and lower walls that are parallel, extend in a longitudinal direction of the beam and are connected by two or more side walls extending in the longitudinal direction, wherein the opening is formed to at least one of the side walls or all side walls, underneath the upper wall and above the lower wall.

3. The supporting beam arrangement according to claim 2, wherein:

the first supporting beam defines a substantially horizontal top surface; and the opening and the end of the second supporting beam in the opening are located underneath the top surface which extends in a continuous manner in the longitudinal direction.

4. The supporting beam arrangement according to claim 1, wherein:

the first supporting beam defines a substantially horizontal top surface; and the opening and the end of the second supporting beam in the opening are located underneath the top surface which extends in a continuous manner in the longitudinal direction.

5. The supporting beam arrangement according to claim 1, wherein the support frame comprises vertical pillars and each end of the first supporting beam is connected to one of the pillars by means of which pillars the first supporting beam is supported by the ground.

6. The supporting beam arrangement according to claim 1, wherein:

the support frame comprises vertical pillars and two substantially horizontal primary supporting beams that are substantially parallel and define two opposite ends that are connected to the pillars by means of which pillars the primary supporting beams are supported by the ground; and each end of the first supporting beam is connected to one of the primary supporting beams, the primary supporting beams being substantially perpendicular to the first supporting beam.

7. The supporting beam arrangement according to claim 1, wherein:

the middle section defines a first beam height and at least one or each one of the end sections defines a second beam height; and the second beam height is smaller than the first beam height and the second beam height is at the most 90% of the first beam height.

8. The supporting beam arrangement according to claim 7, wherein:

the second supporting beam further includes two outer end sections, each outer end section including one of the ends of the second supporting beam and horizontally extending outside the flue gas duct between the flue gas duct and one of the first supporting beams, at least one or each one of the outer end sections defining a third beam height; and the third beam height is smaller than the second beam height and the third beam height is at the most 90% of the second beam height.

9. The supporting beam arrangement according to claim 1, wherein:

the substantially horizontal top surface of at least one or each one of the end sections is located at a second height; and the first supporting beam defines a substantially horizontal top surface at a first height, the second height being less than the first height.

10. The supporting beam arrangement according to claim 9, wherein:

the substantially horizontal top surface of the middle section is located at a third height; and the second height is less than the third height.

11. The supporting beam arrangement according to claim 10, wherein:

the supporting beam arrangement further comprises a substantially horizontal intermediate supporting beam that is substantially parallel with the first supporting beams and substantially perpendicular to the second supporting beam, the intermediate supporting beam being supported by the support frame; and the intermediate supporting beam is in a vertical direction located above the top surface of one of the end sections.

12. The supporting beam arrangement according to claim 9, wherein:

the supporting beam arrangement further comprises a substantially horizontal intermediate supporting beam that is substantially parallel with the first supporting beams and substantially perpendicular to the second supporting beam, the intermediate supporting beam being supported by the support frame; and the intermediate supporting beam is in a vertical direction located above the top surface of one of the end sections.

13. The supporting beam arrangement according to claim 12, wherein:

the supporting beam arrangement further comprises substantially horizontal reinforcing bars each having a first end connected to one of the first supporting beams and an opposing second end connected to the intermediate supporting beam;

the reinforcing bars are substantially perpendicular to the first supporting beams or the reinforcing bars extend at an oblique angle in relation to the first supporting beams; and the reinforcing bars are in a vertical direction located above the top surface of one of the end sections.

14. The supporting beam arrangement according to claim 13, wherein:

at least one or each one of the first supporting beams defines a substantially horizontal top surface; and the reinforcing bars are placed at a height lower than the top surface of the first supporting beam, or the intermediate supporting beam is placed at a height lower than the top surface of the first supporting beam.

15. The supporting beam arrangement according to claim 1, further comprising a slide bearing in the opening, wherein at least one or each one of the ends of the second supporting beam rests on one of the slide bearings, the slide bearing being supported by the first supporting beam.

16. A power boiler comprising a supporting beam arrangement, a flue gas duct, and a support frame of the flue gas duct, wherein the supporting beam arrangement is configured to support the flue gas duct which is adapted to convey flue gases, the supporting beam arrangement being further configured to support the flue gas duct to the support frame of the flue gas duct, the supporting beam arrangement comprising:

two substantially horizontal first supporting beams that are substantially parallel and situated on two opposite sides of the flue gas duct, the first supporting beams being separated by a distance from the flue gas duct, and the first supporting beams including two opposite ends that are connected to the support frame; and a substantially horizontal second supporting beam defining two opposite ends that are supported by the first supporting beams, the second supporting beam extending through the flue gas duct in such a way that the second supporting beam is exposed to flue gases, wherein the flue gas duct is supported by the second supporting beam;

wherein:

at least one or each one of the first supporting beams comprises an opening, in which opening one of the two opposite ends of the second supporting beam is placed to rest on the first supporting beam in such a way that loads incurred by the weight of the flue gas duct are transmitted to the first supporting beam; and the first supporting beam is one of:

an I-beam, including upper and lower flanges that are parallel, extend in a longitudinal direction of the beam, and are connected by a web extending in the longitudinal direction, wherein the opening is formed to the web of the beam, underneath the upper flange and above the lower flange, a H-beam, including upper and lower flanges that are parallel, extend in a longitudinal direction of the beam, and are connected by a web extending in the longitudinal direction, wherein the opening is formed to the web of the beam, underneath the upper flange and above the lower flange, or a box beam including upper and lower walls that are parallel, extend in a longitudinal direction of the beam and are connected by two or more side walls extending in the longitudinal direction, wherein the opening is formed to at least one of the side walls or all side walls, underneath the upper wall and above the lower wall.

17. The power boiler of claim 16, further comprising a slide bearing in the opening, wherein at least one or each one of the ends of the second supporting beam rests on one of the slide bearings, the slide bearing being supported by the first supporting beam.

18. A supporting beam arrangement for supporting a flue gas duct configured to convey flue gases, the supporting beam arrangement being configured to support the flue gas duct to a support frame of the flue gas duct, the supporting beam arrangement comprising:

two substantially horizontal first supporting beams that are substantially parallel and situated on two opposite sides of the flue gas duct, the first supporting beams being separated by a distance from the flue gas duct, and the first supporting beams including two opposite ends that are connected to the support frame; and a substantially horizontal second supporting beam defining two opposite ends that are supported by the first supporting beams, the second supporting beam extending through the flue gas duct in such a way that the second supporting beam is exposed to flue gases, wherein the flue gas duct is supported by the second supporting beam, wherein:

at least one or each one of the first supporting beams comprises an opening, in which opening one of the two opposite ends of the second supporting beam is placed to rest on the first supporting beam in such a way that loads incurred by the weight of the flue gas duct are transmitted to the first supporting beam; and the first supporting beam is one of:

an I-beam, including upper and lower flanges that are parallel, extend in a longitudinal direction of the beam, and are connected by a web extending in the longitudinal direction, wherein the opening is formed to the web of the beam, underneath the upper flange and above the lower flange, a H-beam, including upper and lower flanges that are parallel, extend in a longitudinal direction of the beam, and are connected by a web extending in the longitudinal direction, wherein the opening is formed to the web of the beam, underneath the upper flange and above the lower flange, or a box beam including upper and lower walls that are parallel, extend in a longitudinal direction of the beam and are connected by two or more side walls extending in the longitudinal direction, wherein the opening is formed to at least one of the side walls or all side walls, underneath the upper wall and above the lower wall.

19. The supporting beam arrangement according to claim 18, wherein:

the first supporting beam defines a substantially horizontal top surface; and the opening and the end of the second supporting beam in the opening are located underneath the top surface which extends in a continuous manner in the longitudinal direction.

20. A supporting beam arrangement for supporting a flue gas duct configured to convey flue gases, the supporting beam arrangement being configured to support the flue gas duct to a support frame of the flue gas duct, the supporting beam arrangement comprising:

two substantially horizontal first supporting beams that are substantially parallel and situated on two opposite sides of the flue gas duct, the first supporting beams being separated by a distance from the flue gas duct, and the first supporting beams including two opposite ends that are connected to the support frame; and a substantially horizontal second supporting beam defining two opposite ends that are supported by the first supporting beams, the second supporting beam extending through the flue gas duct in such a way that the second supporting beam is exposed to flue gases, wherein the flue gas duct is supported by the second supporting beam, wherein:

at least one or each one of the first supporting beams comprises an opening, in which opening one of the two opposite ends of the second supporting beam is placed to rest on the first supporting beam in such a way that loads incurred by the weight of the flue gas duct are transmitted to the first supporting beam;

the second supporting beam includes two end sections, each end section horizontally extending outside the flue gas duct between the flue gas duct and one of the first supporting beams, at least one or each one of the end sections defining a substantially horizontal top surface located at a second height; and the first supporting beam defines a substantially horizontal top surface at a first height, the second height being less than the first height.

21. The supporting beam arrangement according to claim 20, wherein:

the second supporting beam comprises a middle section horizontally extending within the flue gas duct, the middle section defining a substantially horizontal top surface located at a third height; and the second height is less than the third height.

* * * * *